US011135476B2

(12) United States Patent
Daniel

(10) Patent No.: US 11,135,476 B2
(45) Date of Patent: Oct. 5, 2021

(54) EXERCISE DEVICES FOR PALMS AND FINGERS ASSEMBLIES THEREOF AND METHOD OF USING THE SAME

(71) Applicant: 4 GRIP LTD, Tel Aviv (IL)

(72) Inventor: Nir Daniel, Tel Aviv (IL)

(73) Assignee: 4 GRIP LTD, Tel Aviv-Jaffa (IL)

( * ) Notice: Subject to any disclaimer, the term of this patent is extended or adjusted under 35 U.S.C. 154(b) by 0 days.

(21) Appl. No.: 17/045,946

(22) PCT Filed: Sep. 8, 2019

(86) PCT No.: PCT/IB2019/057558
§ 371 (c)(1),
(2) Date: Oct. 7, 2020

(87) PCT Pub. No.: WO2020/049537
PCT Pub. Date: Mar. 12, 2020

(65) Prior Publication Data
US 2021/0086029 A1 Mar. 25, 2021

Related U.S. Application Data

(60) Provisional application No. 62/728,813, filed on Sep. 9, 2018.

(51) Int. Cl.
*A63B 23/16* (2006.01)
*A63B 21/00* (2006.01)
*A63B 21/05* (2006.01)

(52) U.S. Cl.
CPC ..... *A63B 23/16* (2013.01); *A63B 21/05* (2013.01); *A63B 21/4035* (2015.10); *A63B 21/4039* (2015.10); *A63B 2209/08* (2013.01)

(58) Field of Classification Search
None
See application file for complete search history.

(56) References Cited

U.S. PATENT DOCUMENTS 3,132,861 A * 5/1964 Horney ..... A63B 21/023 482/46
4,155,547 A * 5/1979 Savio ..... A63B 23/14 482/127
4,591,151 A * 5/1986 Hensley ..... A63B 23/14 482/126
5,263,908 A * 11/1993 Chen ..... A63B 23/12 482/127
5,431,611 A * 7/1995 Silagy ..... A63B 23/16 482/122
6,179,749 B1 * 1/2001 Thorn ..... A63B 21/05 482/44
7,967,732 B2 * 6/2011 D'Addario ..... A63B 23/16 482/47
9,132,315 B1 * 9/2015 Chen ..... A63B 21/4049
9,387,360 B2 * 7/2016 Niederman ..... A63B 23/14
(Continued)

FOREIGN PATENT DOCUMENTS

JP 2011167254 9/2011
WO 2014207955 12/2014

*Primary Examiner* — Joshua Lee
(74) *Attorney, Agent, or Firm* — Mark David Torche; Patwrite Law

(57) ABSTRACT

Devices and methods of exercising palms and fingers are described. The device includes an essentially cylindrical exterior hollow shell and an essentially cylindrical interior hollow shell.

18 Claims, 7 Drawing Sheets

(56) References Cited

U.S. PATENT DOCUMENTS

| | | | | |
|---|---|---|---|---|
| 9,421,419 | B1 * | 8/2016 | Goldberg | A63B 23/16 |
| 9,474,932 | B1 * | 10/2016 | Goldberg | A63B 21/023 |
| 9,700,758 | B1 * | 7/2017 | Goldberg | A63B 21/4035 |
| 10,596,413 | B2 * | 3/2020 | Zerbo | A63B 21/4019 |
| 2010/0279826 | A1 | 11/2010 | Weinstock | |
| 2011/0092346 | A1 * | 4/2011 | Wakuda | A63B 23/14<br>482/121 |

* cited by examiner

EXERCISE DEVICES FOR PALMS AND FINGERS ASSEMBLIES THEREOF AND METHOD OF USING THE SAME

TECHNICAL FIELD

In general, the present invention pertains to the art of physical exercise devices. In particular, the invention relates to an exercise device for palms and/or fingers, assemblies including a plurality of exercise devices as well as an exercise method of using the same.

BACKGROUND ART

It is believed that the current state-of-the-art is represented by U.S. Pat. No. 9,072,939 and US20130196825. U.S. Pat. No. 9,072,939 discloses a hand and finger exerciser having a frame, and a slide configured to move vertically with respect to the frame. US20130196825 discloses an improved finger exerciser to exercise each finger individually by depressing directly against the resistance of a spring.

DESCRIPTION OF THE DRAWINGS

The present invention will be understood and appreciated more comprehensively from the following detailed description taken in conjunction with the appended drawings in which:

FIG. 7A is a schematic side view of a preferred embodiment of an assembly of two exercise devices for palms and fingers and one connector in-between;

FIG. 7B is a schematic front view of a preferred embodiment of an assembly of two exercise devices for palms and fingers and one connector in-between;

Figure 1A:
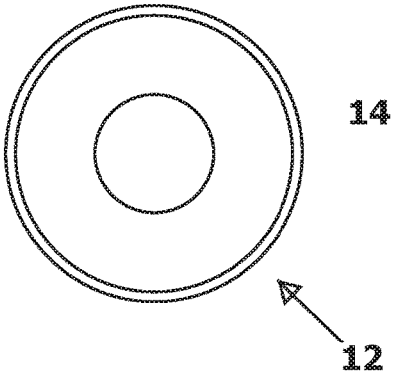
FIG. 1A is a schematic front view of an exterior shell of an embodiment of the exercise device for palms and fingers.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

In accordance with some embodiments of the present invention, reference is now made to FIG. 1A to 5B, showing respectively front, side and isometric views of exterior shell 12 of an embodiment of exercise device 10 for palms and fingers. Exterior shell 12 shown in FIG. 1A to 1C embodies essentially cylindrically shaped hollow structure 14, terminating with essentially semi-spherical dome structure 16.

Figure 1B:
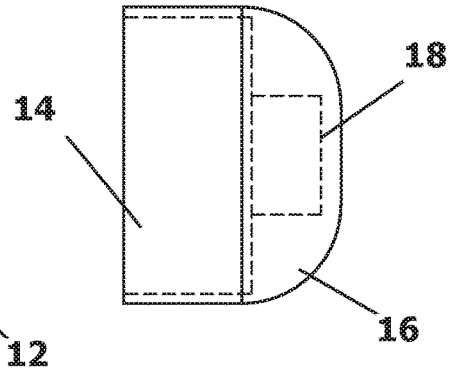
FIG. 1B is a schematic side of an exterior shell of an embodiment of the exercise device for palms and fingers.
Figure 1C:
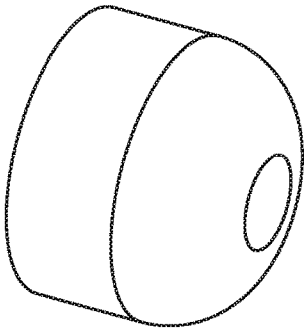
FIG. 1C is a schematic isometric view of an exterior shell of an embodiment of the exercise device for palms and fingers.

Dome structure 16 of exterior shell shown in FIG. 1A to 1C comprises recess 18 on the inner side, configured to accommodate the outer shaft (not shown) of the internal biasing mechanism (not shown). Manual force is exerted onto the outer surface of exterior shell 12 shown in FIG. 1A to 1C by the person undertaking exercise, therefore the outer surface of exterior shell 12 is preferably textured and/or coated with an ergonomic covering.

In accordance with some embodiments of the present invention, reference is now made to FIG. 2A to 5B, showing respectively front, side and isometric views of interior shell 20 of embodiment of exercise device 10 for palms and fingers. Interior shell 20 shown in FIG. 2A to 2C embodies essentially cylindrically shaped hollow structure 22, terminating with essentially semi-spherical dome structure 24.

Figure 2A:
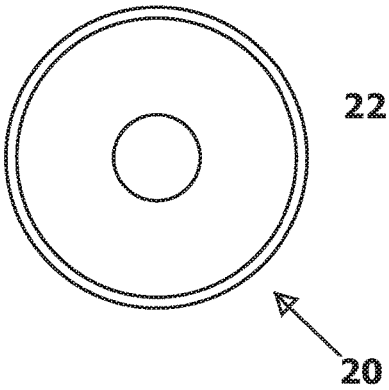
FIG. 2A is a schematic front view of an interior shell of an embodiment of the exercise device for palms and fingers.
Figure 2B:
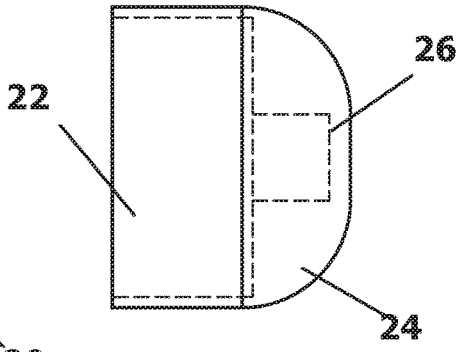
FIG. 2B is a schematic side view of an interior shell of an embodiment of the exercise device for palms and fingers.
Figure 2C:
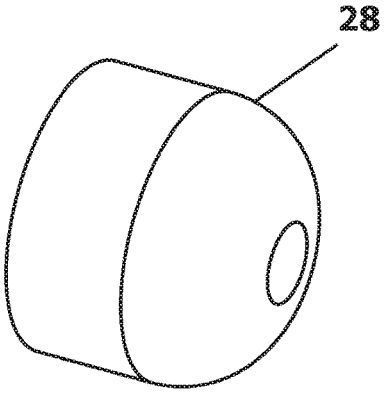
FIG. 2C is a schematic isometric view of an interior shell of an embodiment of the exercise device for palms and fingers.

Dome structure 24 of interior shell 20 shown in FIG. 2A to 2C comprises recess 26 on the inner side, configured to accommodate a terminal portion of the inner shaft (not shown) of the internal biasing mechanism (not shown). Manual force is exerted onto outer surface of exterior shell 28 shown in FIG. 2A to 2C by the person undertaking exercise, therefore outer surface of exterior shell 28 is preferably textured and/or coated with an ergonomic covering.

The outer diameter of interior shell 20 shown in FIG. 2A to 2C is somewhat smaller than the inner diameter of exterior shell 12 shown in FIG. 1A to 1C, so that cylindrically shaped hollow structure 22 of interior shell 20 shown in FIG. 2A to 2C is insertable into cylindrically shaped hollow structure 14 of exterior shell 12 shown in FIG. 1A to 1C and longitudinally translatable therein.

Figure 3A:
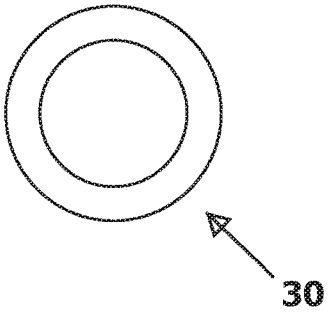
FIG. 3A is a schematic front view of an outer shaft of an embodiment of the exercise device for palms and fingers.
Figure 3B:
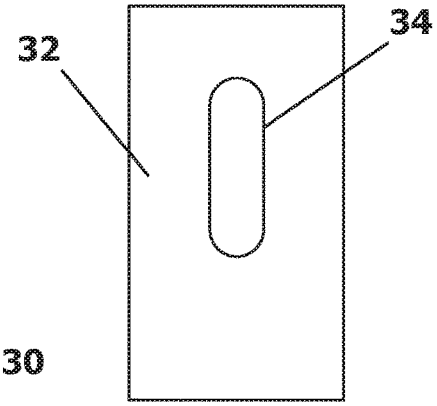
FIG. 3B is a schematic front side of an outer shaft of an embodiment of the exercise device for palms and fingers.
Figure 3C:
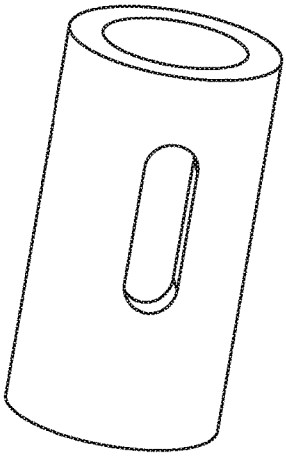
FIG. 3C is a schematic isometric view of an outer shaft of an embodiment of the exercise device for palms and fingers.

In accordance with some embodiments of the present invention, reference is now made to FIG. 3A to 3C, showing respectively front, side and isometric views of outer shaft 30 of an embodiment of the exercise device for palms and fingers. Outer shaft 30 shown in FIG. 3A to 3C embodies an essentially cylindrically shaped elongated hollow structure 32. Essentially cylindrically shaped elongated hollow structure 32 shown in FIG. 3A to 3C comprises elongated oval aperture 34 extending along a substantial portion of the lengths thereof.

Figure 4A:
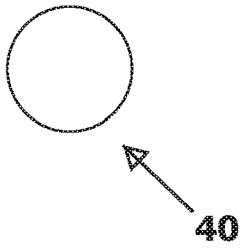
FIG. 4A is a schematic front view of an inner shaft of an embodiment of the exercise device for palms and fingers.
Figure 4B:
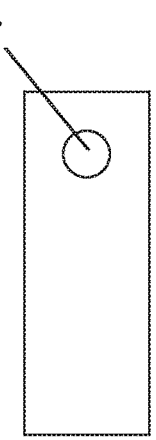
FIG. 4B is a schematic side view of an inner shaft of an embodiment of the exercise device for palms and fingers.
Figure 4C:
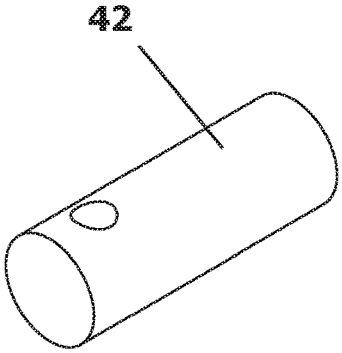
FIG. 4C is a schematic isometric view of an inner shaft of an embodiment of the exercise device for palms and fingers.

In accordance with some embodiments of the present invention, reference is now made to FIG. 4A to 4C, showing respectively front, side and isometric views of inner shaft 40 of an embodiment of the exercise device for palms and fingers. The inner shaft 40 shown in FIG. 4A to 4C embodies essentially cylindrically elongated rod-shaped structure 42. Essentially cylindrically elongated rod-shaped structure 42 of inner shaft 40 shown in FIG. 4A to 4C comprises a circular aperture 44 towards one of the ends thereof.

Figure 5A:
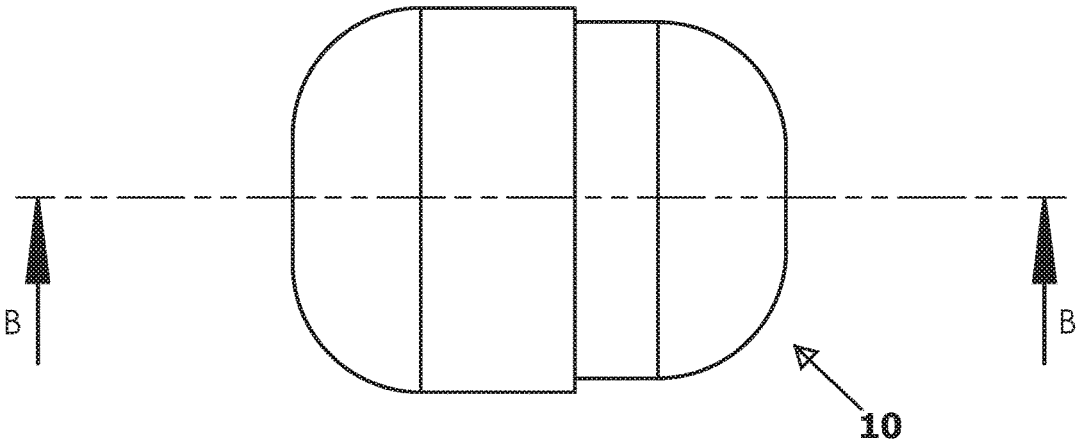
FIG. 5A is a schematic side view of exemplary exercise device for palms and fingers, in accordance with an embodiment of the present invention.
Figure 5B:
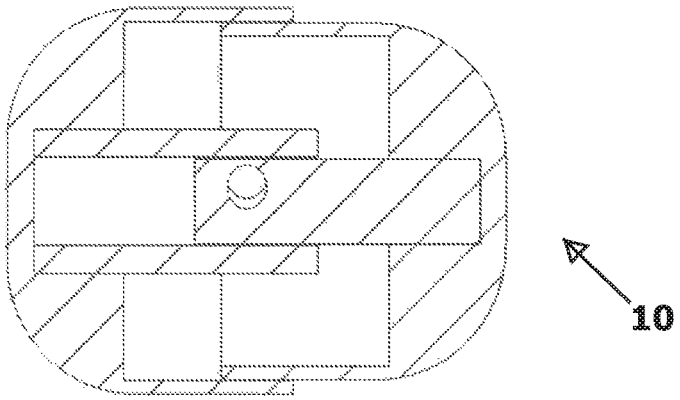
FIG. 5B is a schematic cross-sectional view of the exemplary exercise device for palms and fingers, taken along cross-section line B-B in FIG. 5A, in accordance with an embodiment of the present invention.

In accordance with some embodiments of the present invention, reference is now made to FIGS. 5A and 5B, a schematic side view of exemplary exercise device 10 for palms and fingers and a schematic cross-sectional view of the exemplary exercise device 10, taken along cross-section line B-B. Cylindrically shaped hollow structure 22 of interior shell 20 shown in FIG. 2A to 2C is insertable into cylindrically shaped hollow structure 14 of exterior shell 12 shown in FIG. 1A to 1C and longitudinally translatable therein.

Inner shaft 40 shown in FIG. 4A to 4C is inserted into outer shaft 30 shown in FIG. 3A to 3C comprises and longitudinally translatable therein. A locking pin (not shown) is inserted throughout into oval aperture 34 in the outer shaft 30 shown in FIG. 3A to 3C and the circular aperture 44 towards one of the ends of the inner shaft 40 shown in FIG. 4A to 4C, thereby locking the outer shaft 30 shown in FIG. 3A to 3C and the inner shaft 40 shown in FIG. 4A to 4C together.

A biasing means (not shown) is inserted into hollow portion 32 of outer shaft 30 shown in FIG. 3A to 3C resisting to the insertion of the inner shaft 40 shown in FIG. 4A to 4C into the outer shaft 30. The biasing means (not shown) typically comprises a spring, however, the usage of elastomers as a biasing means is equally contemplated by this disclosure.

Figure 6A:
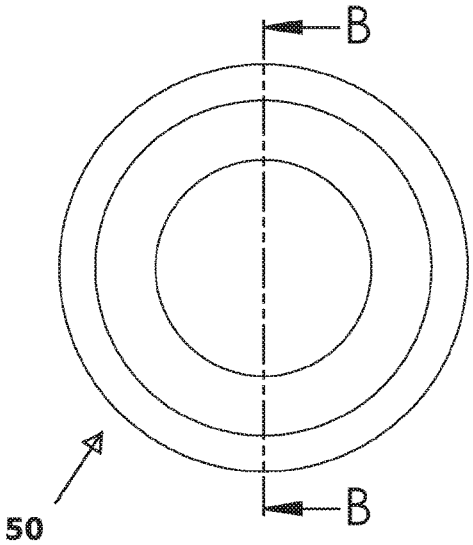
FIG. 6A is a schematic front view of a preferred embodiment of a connector for exercise devices for palms and fingers.
Figure 6B:
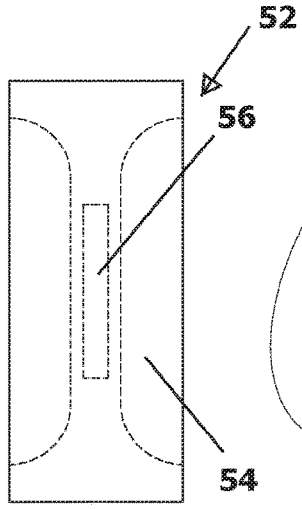
FIG. 6B is a schematic cross-sectional view of a preferred embodiment of a connector for exercise devices for palms and fingers, taken along cross-section line B-B in FIG. 6A.
Figure 6C:
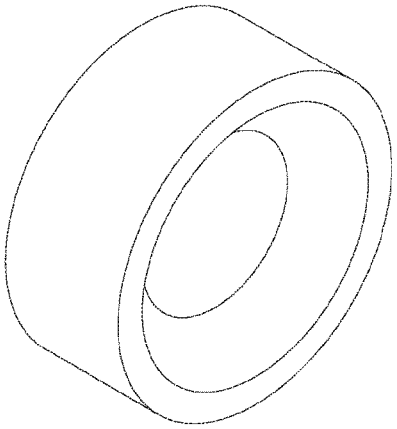
FIG. 6C is a schematic isometric view of a preferred embodiment of a connector for exercise devices for palms and fingers.

In accordance with some preferred embodiments of the present invention, reference is now made to FIG. 6A to 6C, showing front, isometric and cross-sectional view taken along cross-section line B-B of connector 50, configured for interconnecting in-between two exercise devices 10 for palms and fingers (not shown) in tandem. Connector 50 for interconnecting in-between two exercise devices for palms and fingers (not shown) in tandem, shown in FIG. 6A to 6C, comprises essentially cylindrical discoid body 52 with two frusto-spherical concave recesses 54, on both sides of essentially cylindrical discoid body 52 of connector 50.

Magnet 56 is embedded into the partition dividing in between two frusto-spherical concave recesses 54 from both sides of the essentially cylindrical discoid body 52 of connector 50 shown in FIG. 6A to 6C. Magnet 56 is embedded into the partition dividing in between two frusto-spherical concave recesses 54 is configured to releasable docket two exercise devices for palms and fingers within the frusto-spherical concave recesses 54 of essentially cylindrical discoid body 52 of connector 50 shown in FIG. 6A to 6C.

Figure 7A:
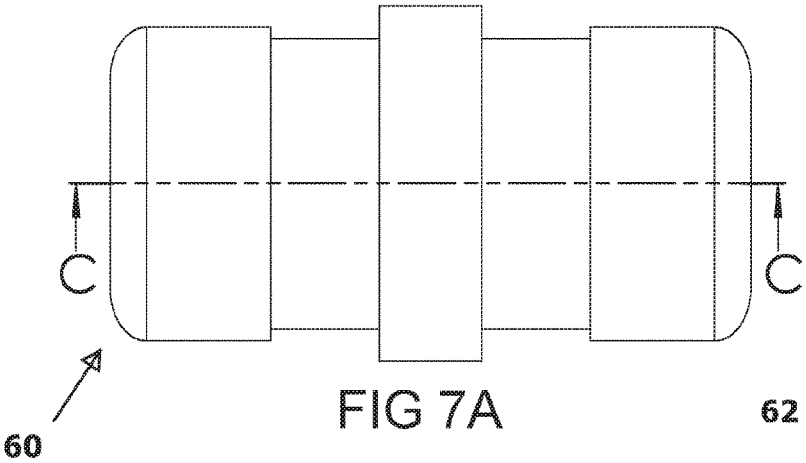
Figure 7B:
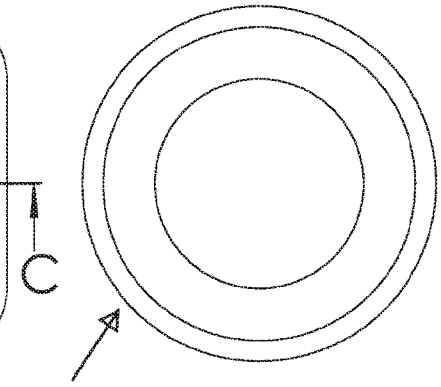
Figure 7C:
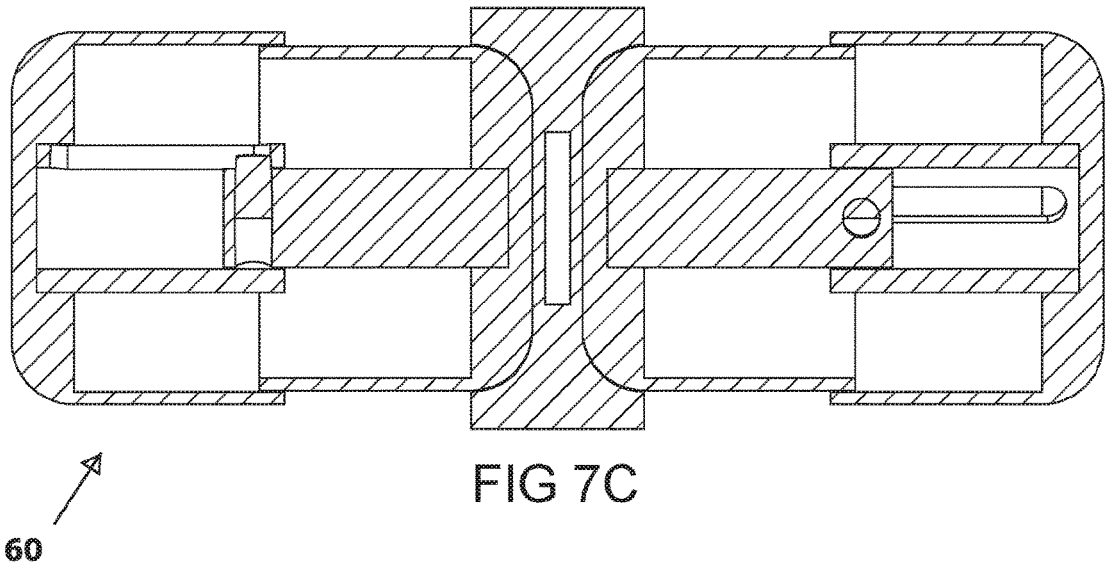
FIG. 7C is a schematic cross-sectional view of a preferred embodiment of an assembly of two exercise devices for palms and fingers and one connector in-between, taken along cross-section line C-C in FIG. 7A.

In accordance with some preferred embodiments of the present invention, reference is now made to FIG. 7A to 7C, a showing side, front and cross-sectional view taken along cross-section line C-C of an embodiment of assembly of two exercise devices for palms and fingers connected by a connector 60. Assembly 60 shown in FIG. 7A to 7C comprises two exercise devices for palms and connector 62 disposed in-between the two exercise devices.

The exercise devices for palms and fingers of assembly 60 shown in FIG. 7A to 7C, in accordance with some embodiments of the present invention, are constructed essentially similarly to the exercise devices for palms and fingers elaborated supra and shown in FIGS. 5A and 5B but shaped preferably somewhat shorter than the exercise devices for palms and fingers shown in FIGS. 5A and 5B. Connector 62 in the assembly shown in FIG. 7A to 7C is essentially similar to the connector 50 shown in FIG. 6A to 6C.

The exercise devices for palms and fingers shown in FIG. 7A to 7C are magnetically docketed within frusto-spherical concave recesses 54 of essentially cylindrical discoid body 52 of connector 50 shown in FIG. 6A to 6C. Assembling an assembly, similar to the assembly 60 shown in FIG. 7A to 7C, combining exercise devices for palms and fingers having different biasing strengths, in order to compile an assembly of different accumulative strengths is contemplated as one preferred embodiment of method of the present invention.

Figure 8A:
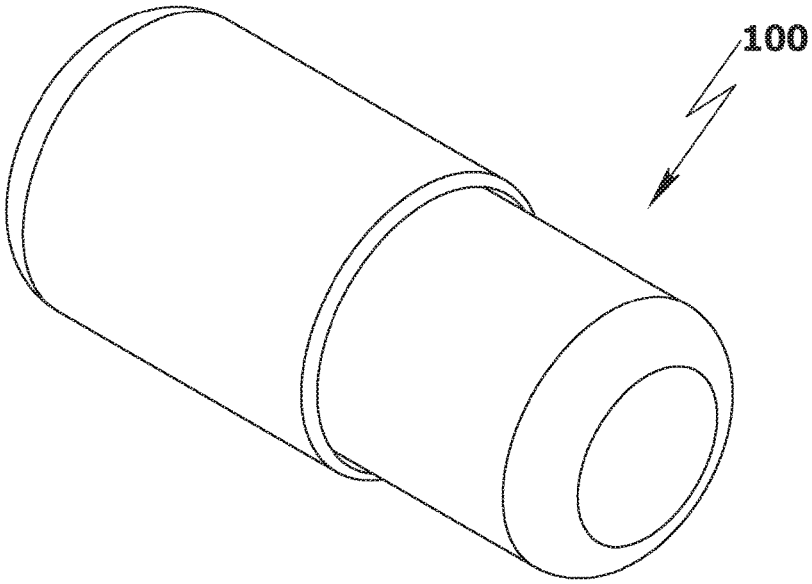
FIG. 8A is a schematic isometric view of a preferred embodiment of the exercise device for palms and fingers.
Figure 8B:
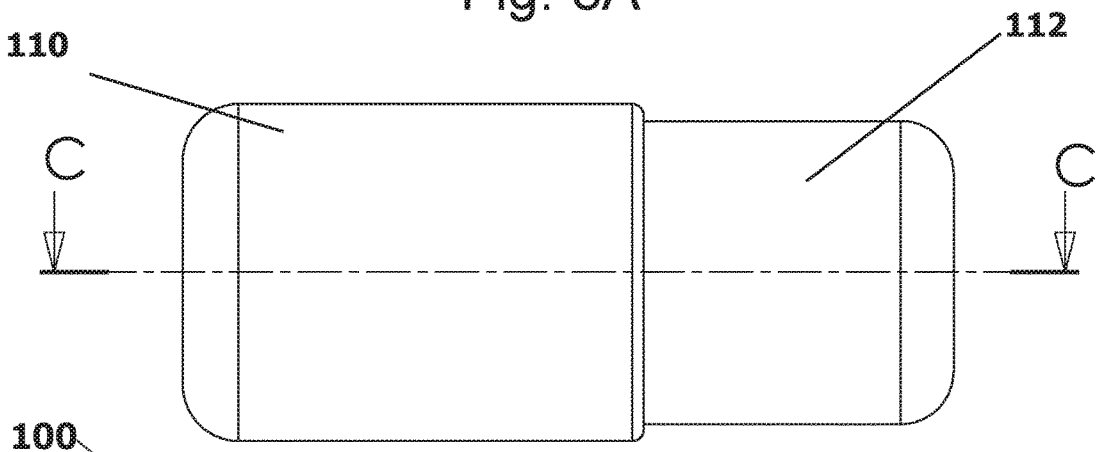
FIG. 8B is a schematic front view of a preferred embodiment of the exercise device for palms and fingers.
Figure 8C:
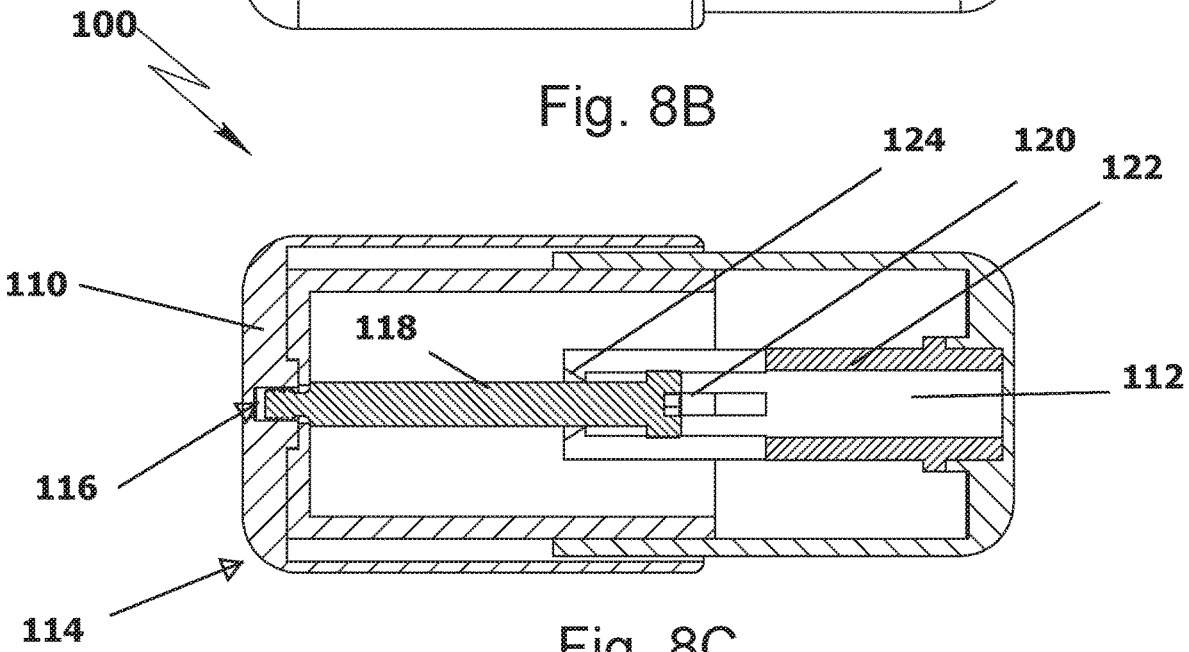
FIG. 8C is a schematic cross-sectional view of a preferred embodiment of the exercise device for palms and fingers, taken along cross-section line C-C in FIG. 8A.

In accordance with some preferred embodiments of the present invention, reference is now made to FIG. 8A to 8C, showing respectively isometric, front and cross-sectional views of the exercise device 100 for palms and fingers. Exercise device for palms and fingers 100 shown in FIG. 8A to 8C embodies an essentially cylindrically shaped hollow exterior shell 110 and interior shell 112, terminating with essentially semi-spherical dome structure 114.

It is noted that a preferable embodiment of hollow exterior shell 110 and interior shell 112 of exercise device for palms and fingers 100 shown in FIG. 8A to 8C is a cylindrical shape, sustaining rotation of exterior shell 110 relative to interior shell 112 and vice versa. Rotation of exterior shell 110 relative to interior shell 112 facilitates a yet broader range of exercises achievable by device 100. In embodiments where a non-cylindrical shape of exterior shell 110 and interior shell 112 is implemented, no rotation of exterior shell 110 relative to interior shell 112 is possible.

Dome portion 114 of exterior shell 110 shown in FIG. 8A to 8C comprises recess 116 on the inner side, configured to accommodate a proximal terminal portion of the inner shaft 118, typically by a means of screw threading. Distal terminal portion 120 of inner shaft 118 of exercise device 100 for palms and fingers comprises a cap like structure, having an exterior diameter larger than the elongated central portion of shaft 118.

Interior shell 112 shown in FIG. 8A to 8C comprises an inner tubular structure 122, accommodating the biasing mechanism (not shown). Inner tubular structure 122 comprises a plurality of elongated recesses, defining a plurality of forwardly extending arms, which terminate with unidirectional locking elements 124. Upon surpassing the cap like structure at the terminal portion of inner shaft 118, the plurality of forwardly extending arms lock with the unidirectional locking elements 124 interior shell 112 and inner shaft 118.

Figure 9A:
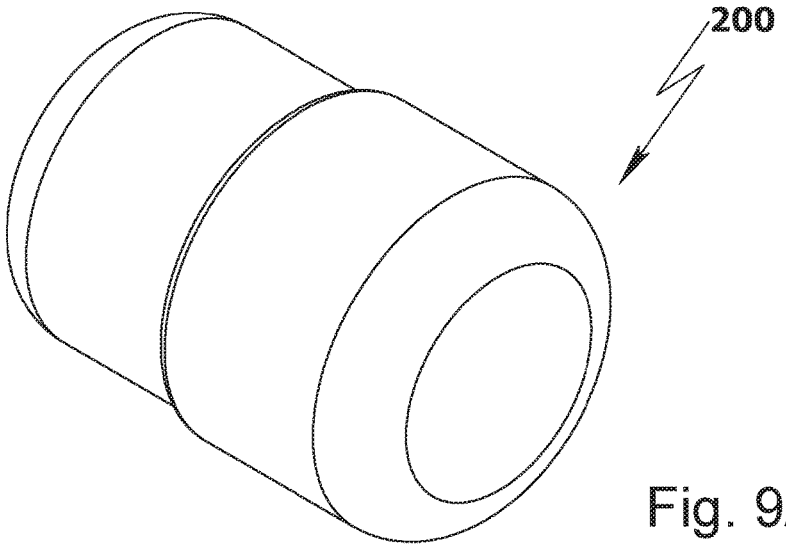
FIG. 9A is a schematic isometric view of another preferred embodiment of the exercise device for palms and fingers.
Figure 9B:
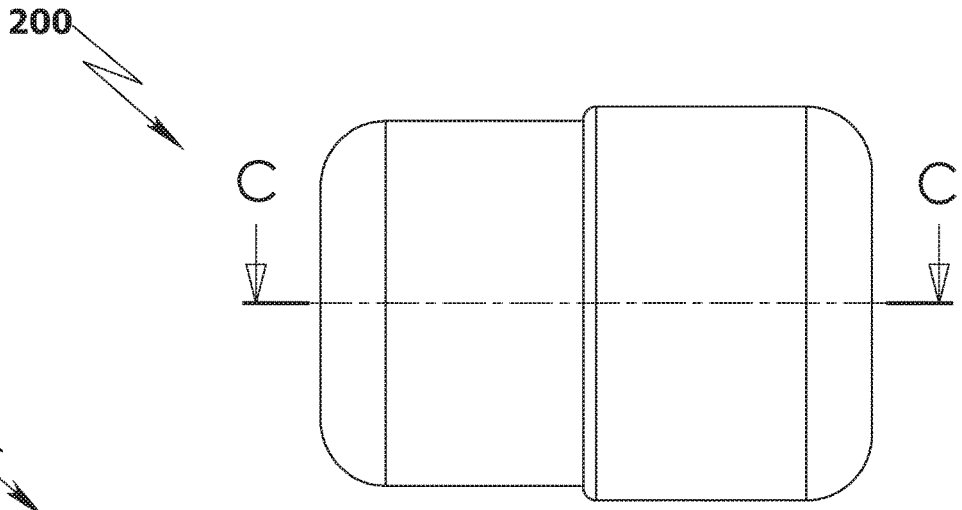
FIG. 9B is a schematic front view of another preferred embodiment of the exercise device for palms and fingers.
Figure 9C:
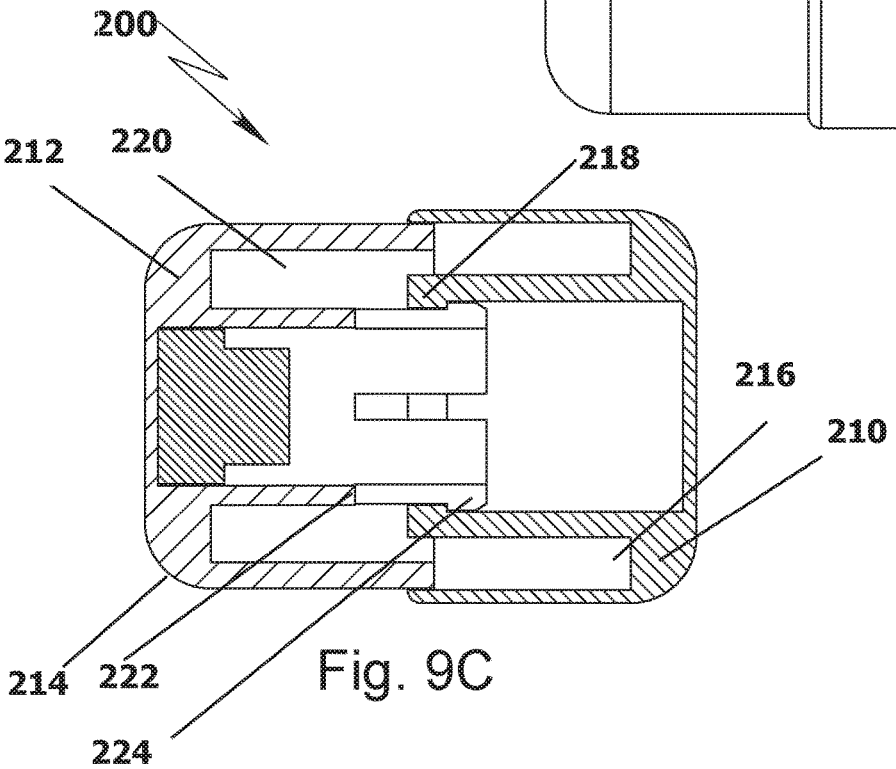
FIG. 9C is a schematic cross-sectional view of another preferred embodiment of the exercise device for palms and fingers, taken along cross-section line C-C in FIG. 9A.

In accordance with some other preferred embodiments of the present invention, reference is now made to FIG. 9A to 9C, showing respectively isometric, front and cross-sectional views of a miniature exercise device 200 for palms and fingers. Miniature exercise device 200 shown in FIG. 9A to 9C embodies an essentially cylindrically and/or spherically shaped hollow exterior 210 and interior shells 212, terminating with an essentially semi-spherical dome structure 214.

Dome portion 214 of exterior shell 210 shown in FIG. 9A to 9C comprises a tubular extension 216 on the inner side, configured to accommodate a biasing mechanism (not shown). Tubular extension 216 on the inner side of dome portion 214 of exterior shell 210 shown in FIG. 9A to 9C comprise a plurality of elongated recesses 218, defining a plurality of interlocking arms, which terminate with inwardly facing unidirectional locking elements. Interior shell 212 shown in FIG. 9A to 9C comprises an inner tubular structure 220, accommodating the biasing mechanism (not shown) and optionally an abutment therefor. Inner tubular structure 220 on interior shell 212 shown in FIG. 9A to 9C comprises a plurality of elongated recesses 222, defining a plurality of interlocking arms, which terminate with outwardly facing unidirectional locking elements 224. Upon surpassing the inwardly facing unidirectional locking elements 224 on interlocking arms of tubular extension 216 on inner side 214 of dome portion 210 of exterior shell shown in FIG. 9A to 9C, the outwardly facing unidirectional locking elements on plurality of interlocking extending arms of inner tubular structure 220 on interior shell 212, lock exterior shell 210 to interior shell 212.

In accordance with some other preferred embodiments of the present invention, reference is now made to FIG. 10A to 10D, showing respectively isometric, cross-sectional view taken along cross-section line B-B, cross-sectional view taken along cross-section line C-C as well as an exploded isometric view of the exercise device 300 for palms and fingers, characterized by several easily exchangeable grades and/or levels of exercise strength. Exercise device 300 shown in FIG. 10A to 10D embodies an essentially cylindrically shaped hollow exterior shell 310, terminating with an essentially semi-spherical dome structure 312.

Dome structure 312 of exterior shell 310 shown in FIG. 10A to 10D comprises a recess on the inner side, configured to accommodate one terminal portion of the inner shaft 314, typically by a means of screw threading. Another terminal portion of inner shaft 314 of exercise device 300 for palms and fingers comprises a cap like structure, having an exterior diameter 316 larger than the elongated central portion of the shaft 314.

The interior shell which embodying a drum structure 324 rotatable upon inner shaft 314 comprises a plurality of elongated apertures, extending throughout body of the drum 324. The plurality of elongated apertures, extending throughout the body of the drum 324, are entirely open at one end and partially occluded at the other end, defining throughout apertures therein.

The plurality of elongated apertures configured to accommodate a plurality of biasing mechanisms (not shown), of different levels of biasing strength. The plurality of elongated apertures accommodate a plurality of head elements for biasing mechanisms (not shown), disposed in-between the biasing mechanisms (not shown) and the throughout apertures in partially occluded ends of drum 324.

Figure 10A:
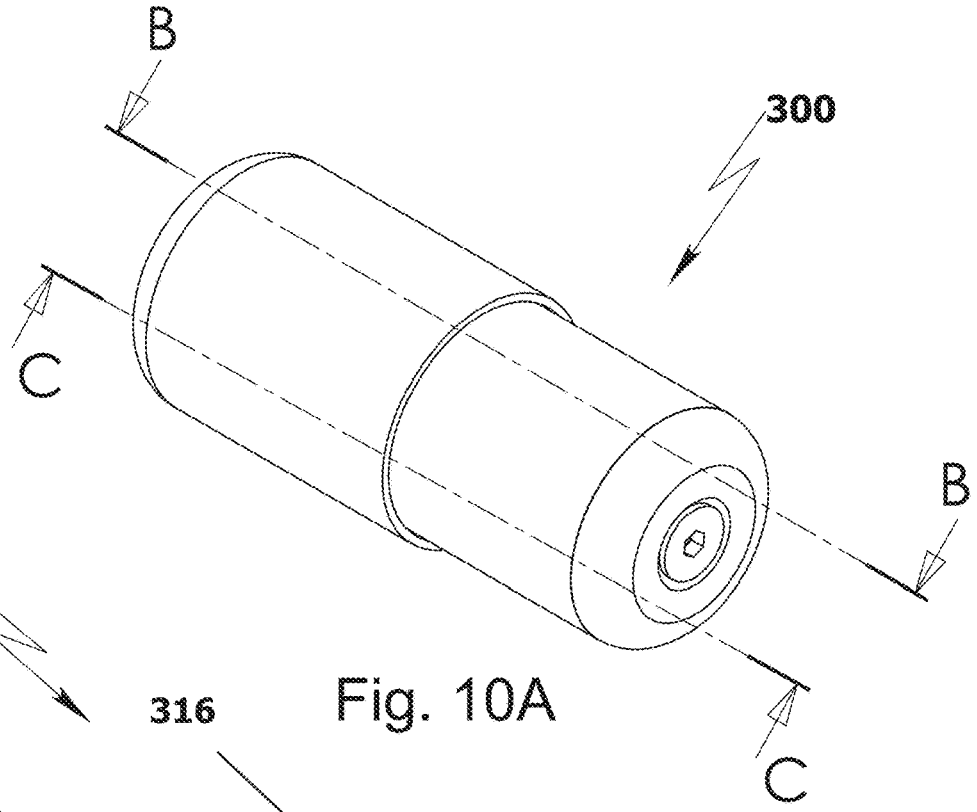
FIG. 10A is a schematic isometric view of yet another preferred embodiment of the exercise device for palms and fingers.
Figure 10B:
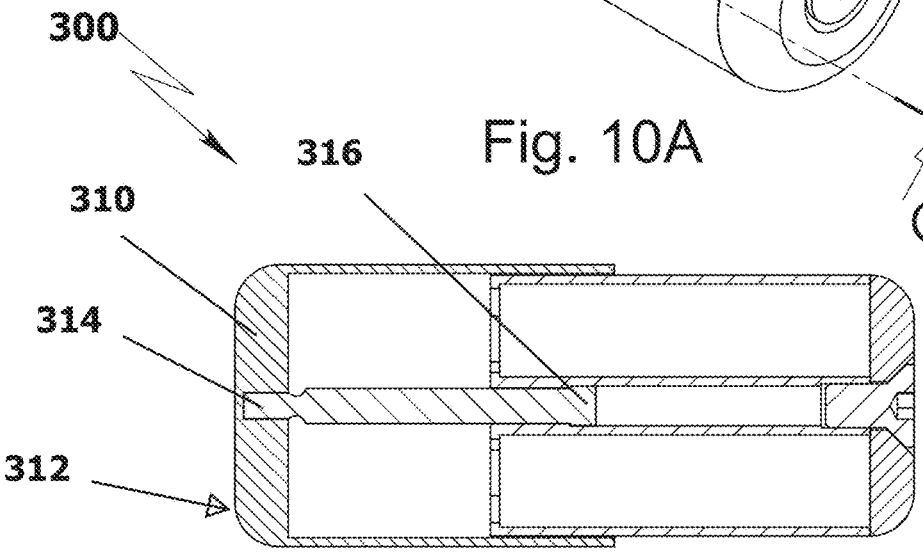
FIG. 10B is a schematic cross-sectional view of yet another preferred embodiment of the exercise device for palms and fingers, taken along cross-section line B-B in FIG. 10A.
Figure 10C:
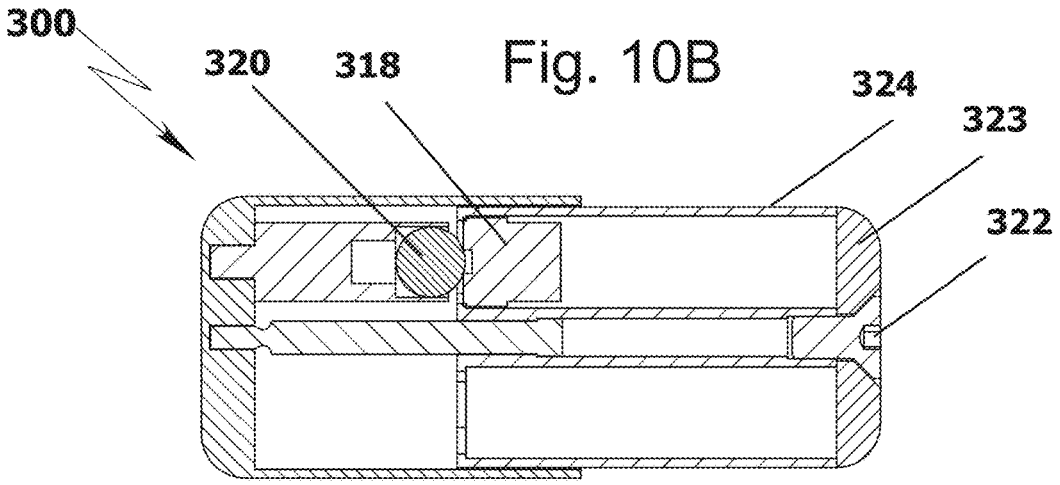
FIG. 10C is a schematic cross-sectional view yet another preferred embodiment of the exercise device for palms and fingers, taken along cross-section line C-C in FIG. 10A.
Figure 10D:
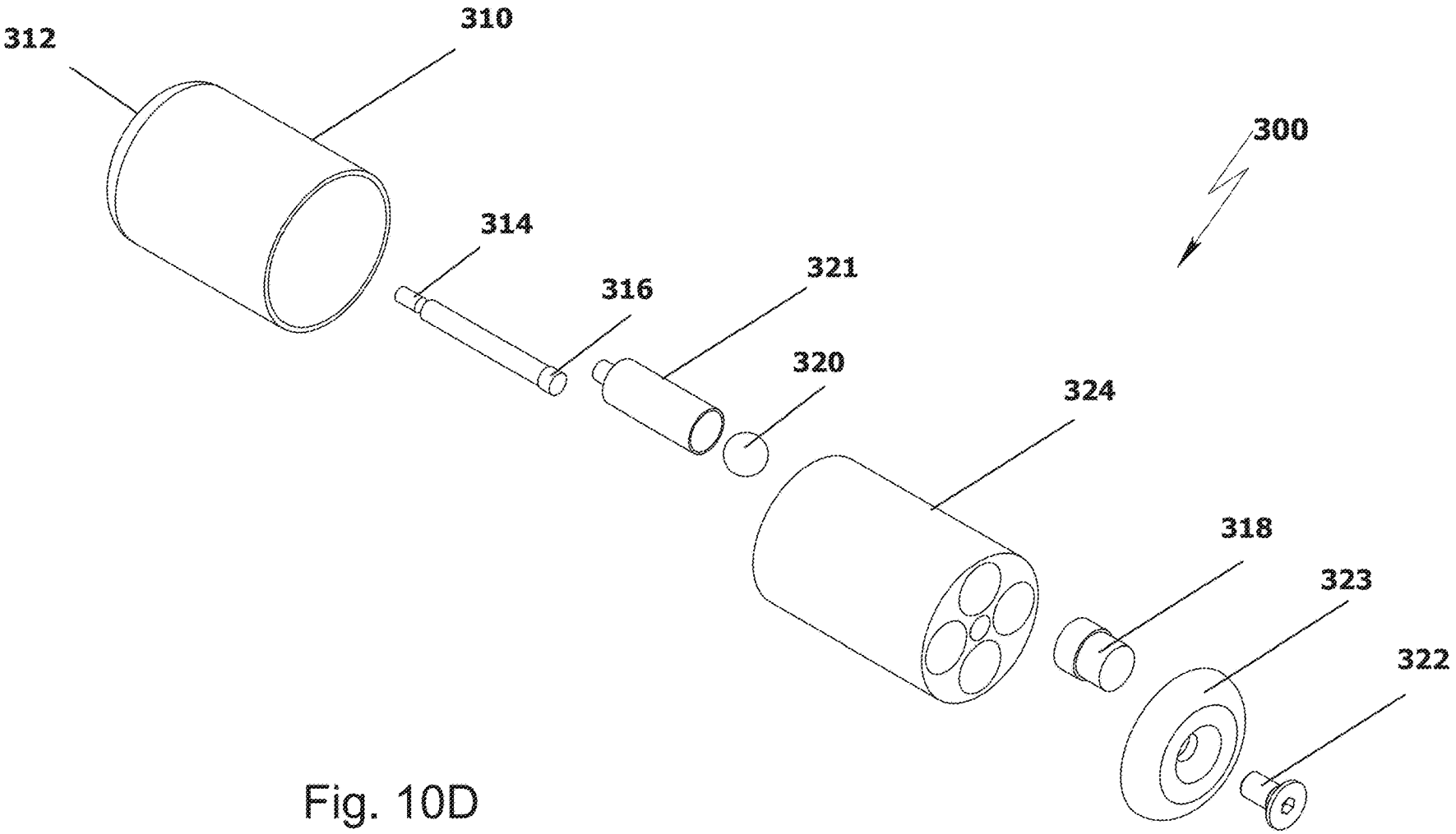
FIG. 10D is an exploded isometric view of yet another preferred embodiment of the exercise device for palms and fingers.

The exterior shell 310 shown in FIG. 10A to 10D accommodates an abutment for a pointing element, such as ball 320, shown in FIG. 10C, whereas the plurality of head elements 318 for biasing mechanisms (not shown), disposed underneath the throughout apertures in partially occluded ends of the elongated apertures in drum 324, comprise a recess configured to engage with the outwardly protruding portion of the pointing element.

The entirely open ends of elongated apertures in the body of drum 324 are covered by annular cover 323. Annular cover 323 is affixed to drum 324, from the side of open entirely ends of elongated apertures, for instance by a means of a bolt or rivet 322.

Upon rotating the exterior shell 310 relatively to the drum of interior shell 324, each time the head of a different biasing mechanism (not shown), in a different throughout aperture of drum 324, is engaged to the outwardly protruding element of the pointing part 321, via the throughout apertures in partially occluded end of respective elongated aperture in drum 324. Upon engaging the outwardly protruding portion of the pointing element, to the head of a given biasing mechanism (not shown), in a given elongated aperture in the drum, the respective biasing mechanism (not shown) with a particular level of biasing strength is preselected for the exercise with the device.

It will be appreciated by persons skilled in the art that the present invention is not limited by what has been particularly shown and described herein above. Rather the scope of the invention is defined by the claims which follow:

The invention claimed is:

1. A configurable exercise device for palms and fingers comprising:

a) a cylindrical exterior hollow shell terminating with a semi-spherical dome structure;

wherein said dome structure of said exterior shell comprises a recess on an inner side;

b) an annular cover with a dome structure;

c) an elongated inner shaft, wherein said inner shaft is affixable in said recess on said inner side of said dome structure of said exterior shell;

d) a revolving drum comprising a plurality of longitudinal apertures, wherein each one of said plurality of longitudinal apertures is configured to accommodate a biasing mechanism;

wherein said drum is insertable into said exterior shell and longitudinally translatable therein;

e) an elongated hollow channel formed within said drum, wherein said inner shaft is insertable into said elongated hollow channel and longitudinally translatable therein;

f) at least one biasing mechanism, configured to drive said cylindrical exterior hollow shell away from said cylindrical interior hollow shell;

wherein said at least one biasing mechanism comprises a particular biasing strength;

wherein said revolving drum is configured for selecting said at least one biasing mechanism upon rotation of said drum, thereby forming a plurality of configurations of said configurable exercise device, wherein at least one configurations said plurality of configurations of is characterized by said particular biasing strength.

2. The configurable exercise device according to claim 1, wherein an outer diameter of said drum is less than an inner diameter of said exterior shell.

3. The configurable exercise device according to claim 1, wherein an exterior surface of said shells comprises a textured or ergonomic covering.

4. An assembly comprising:

a) a first configurable exercise device according to claim 1;

b) a second configurable exercise device according to claim 1;

c) a connector comprising a cylindrical discoid body with two frusto-spherical concave recesses on both sides of said discoid body of said connector;

wherein said connector comprises a magnet embedded into a partition positioned in between said two frusto-spherical concave recesses;

d) wherein said connector is configured to interconnect in-between said first configurable exercise device and said second configurable exercise device in tandem.

5. The assembly according to claim 4, wherein said assembly comprises said first and second configurable exercise devices having different biasing strengths.

6. The configurable exercise device according to claim 1, wherein a proximal terminal portion of said inner shaft is fixable in said recess on said inner side of said dome structure of said exterior shell; wherein a distal terminal portion of said inner shaft of said exercise device comprises a cap which has an exterior diameter larger than a diameter of an elongated central portion of said inner shaft.

7. The configurable exercise device according to claim 1, wherein said at least one biasing mechanism comprises a pointing element, wherein said configurable exercise device comprises at least one recess configured to engage with said pointing element, thereby affixing said configurable exercise device in a preselected configuration.

8. The configurable exercise device, according to claim 1, wherein said plurality of longitudinal apertures extend throughout said drum.

9. A configurable exercise device for palms and fingers comprising:

a) a cylindrical exterior hollow shell terminating with a semi-spherical dome structure;

wherein said dome structure of said exterior shell comprises a recess on an inner side;

b) an annular cover with a dome structure;

c) an elongated inner shaft, wherein said inner shaft is affixable in said recess on said inner side of said dome structure of said exterior shell;

d) a revolving drum comprising a plurality of longitudinal apertures, wherein each one of said plurality of longitudinal apertures is configured to accommodate a biasing mechanism;

wherein said drum is insertable into said exterior shell and longitudinally translatable therein;

e) an elongated hollow channel formed within said drum, wherein said inner shaft is insertable into said elongated hollow channel and longitudinally translatable therein;

f) at least one biasing mechanism, configured to drive said cylindrical exterior hollow shell away from said drum;

wherein said at least one biasing mechanism comprises a particularly selected biasing strength;

wherein said revolving drum is configured for selecting said at least one biasing mechanism upon rotation of said drum, thereby forming a plurality of configurations of said configurable exercise device.

10. The configurable exercise device according to claim 9, wherein an outer diameter of said drum is less than an inner diameter of said exterior shell.

11. The configurable exercise device according to claim 9, wherein an outer surface of said exterior shell comprises a textured or ergonomic covering.

12. An assembly comprising:

a) a first configurable exercise device according to claim 9;

b) a second configurable exercise device according to claim 11;

c) a connector comprising a cylindrical discoid body with two frusto-spherical concave recesses on both sides of said discoid body of said connector; wherein said connector comprises a magnet embedded into a partition positioned in between said two frusto-spherical concave recesses;

d) wherein said connector is configured to interconnect in-between said first configurable exercise device and said second configurable exercise device in tandem.

13. The configurable exercise device according to claim 9, wherein said at least one biasing mechanism comprises a pointing element, wherein said configurable exercise device comprises a plurality of recesses configured to engage with said pointing element, thereby affixing said configurable exercise device in a preselected configuration.

14. The configurable exercise device according to claim 9, wherein a proximal terminal portion of said inner shaft is affixable in said recess on said inner side of said dome structure of said exterior shell; wherein a distal terminal portion of said inner shaft of said exercise device comprises a cap which has an exterior diameter larger than a diameter of an elongated central portion of said inner shaft.

15. The configurable exercise device according to claim 9, wherein said plurality of longitudinal apertures extend throughout said drum.

16. A method of exercising palms and fingers comprising:

a) providing a configurable exercise device for palms and fingers comprising:

(i) a cylindrical exterior hollow shell terminating with a semi-spherical dome structure;

wherein said semi-spherical dome structure of said exterior hollow shell comprises a recess on an inner side;

(ii) an annular cover with a dome structure;

(iii) an elongated inner shaft, wherein said inner shaft is affixable in said recess on said inner side of said dome structure of said exterior shell;

(iv) a revolving drum comprising a plurality of longitudinal apertures, wherein each one of said plurality of longitudinal apertures is configured to accommodate a biasing mechanism;

wherein said drum is insertable into said exterior shell and longitudinally translatable therein;

(v) an elongated hollow channel formed within said drum, wherein said inner shaft is insertable into said elongated hollow channel and longitudinally translatable therein;

(vi) at least one biasing mechanism, configured to drive said cylindrical exterior hollow shell away from said cylindrical interior hollow shell; wherein said at least one biasing mechanism comprises a particularly selected biasing strength;

wherein said revolving drum is configured for selecting said at least one biasing mechanism, of said particularly selected, upon rotation of said drum, thereby forming a plurality of configurations of said configurable exercise device;

b) exerting a manual compressing force onto at least one member selected from the group consisting of: said cylindrical exterior hollow shell and said annular cover;

c) releasing said manual compressing force;

d) iteratively repeating said steps of exerting and releasing;

e) rotating said drum and thereby selecting a specific biasing mechanism of a particular biasing strength.

17. The method of exercising palms and fingers, according to claim 16, wherein said at least one biasing mechanism of said configurable exercise device comprises a pointing element and wherein said configurable exercise device further comprises at least one recess configured to engage with said pointing element, thereby rendering said configurable exercise device affixable in a preselected configuration; said method further comprising a step of affixing said configurable exercise device in said preselected configuration.

18. The method of exercising palms and fingers, according to claim 16, wherein said plurality of longitudinal apertures in said revolving drum of said configurable exercise device extend throughout said drum.

* * * * *